United States Patent [19]

Tari

[11] 3,956,992

[45] May 18, 1976

[54] WIDE-ANGLE INERTIAL IMPACT FUZE

[75] Inventor: Michael T. Tari, Newton, N.J.

[73] Assignee: The United States of America as represented by the Secretary of the Army, Washington, D.C.

[22] Filed: Aug. 1, 1974

[21] Appl. No.: 493,954

[52] U.S. Cl. ..... 102/73 A; 102/76 P; 102/79

[51] Int. Cl.[2] ..... F42C 15/22; F42C 1/00; F42C 15/26

[58] Field of Search ..... 102/73 A, 76 R, 76 P, 102/79, 72

[56] References Cited

UNITED STATES PATENTS

| | | | |
|---|---|---|---|
| 2,748,708 | 6/1966 | Bertram | 102/76 P |
| 2,826,146 | 3/1958 | Porter | 102/79 |
| 3,264,995 | 8/1966 | Libby et al. | 102/79 |
| 3,580,174 | 5/1971 | Apotheloz et al. | 102/7.2 |

FOREIGN PATENTS OR APPLICATIONS

| | | | |
|---|---|---|---|
| 102,279 | 10/1916 | United Kingdom | 102/73 A |
| 1,127,761 | 4/1962 | Germany | 102/73 A |
| 315,825 | 11/1919 | Germany | 102/73 A |

*Primary Examiner*—Samuel W. Engle
*Assistant Examiner*—S. A. Cangialosi
*Attorney, Agent, or Firm*—Nathan Edelberg; A. Victor Erkkila; Thomas R. Webb

[57] ABSTRACT

An inertial-type all-way fuze for explosive projectiles comprises: a cup-shaped housing having an axial bore at its forward end and a detonator mounted in a spin-armed slide movable into alignment with the bore; a firing member having a shaft slidable in the bore, a firing pin adapted to initiate the detonator and an intermediate radial actuating flange; and an annular inertial actuator member having a rearwardly-facing internal, conical surface at its rear end engaging the forward edge of the flange, in the armed condition of the fuze, and an external annular surface at its forward end adjacent to an internal cylindrical surface on the housing, whereby, on graze impact with a target at substantially any angle, the actuator member pivots about a fulcrum formed by the two annular surfaces, and the conical surface cams the flange rearwardly to initiate the detonator. The firing member shaft extends forwardly beyond the housing for direct impact actuation of the fuze. A weak spring biases the firing pin away from the detonator. A spin-removed clip retains the firing pin in safe condition prior to launch.

9 Claims, 4 Drawing Figures

WIDE-ANGLE INERTIAL IMPACT FUZE

BACKGROUND AND SUMMARY OF THE INVENTION

The present invention relates to an improved fuze, for detonating the explosive charge of a projectile, of the type designed for initiation of the fuze by wide-angle or graze impact, sometimes called "All Way" fuzes. Most fuzes designed for direct or head-on impact with a target become less and less reliable as the angle of incidence increases, and become inoperative at grazing angles. Thus, it has become necessary to design fuzes especially for grazing impact, while retaining the ability to respond to direct impact.

Some all-way fuzes incorporating inertial weights have been proposed. For example, in G. Webb U.S. Pat. No. 3,371,608, the firing pin of the fuze is actuated by a spherical ball weight that shifts laterally on graze impact and engages a conical surface on the firing member to actuate the latter in opposition to a biasing spring. One disadvantage of this device is that the mass of the ball weight is small compared to the mass of the firing member.

An object of the present invention is to provide an improved inertial, all-way, impact fuze. In accordance with the invention, a firing member of relatively small mass is actuated by engagement of a circular flange thereon by an internal conical surface on one end of an annular inertial member of relatively large mass, which shifts laterally in the fuze housing on graze impact of the fuze with a target. The inertial member pivots about a fulcrum formed by engagement of the other end thereof with the housing wall.

DETAILED DESCRIPTION OF A PREFERRED EMBODIMENT

Figure 1:
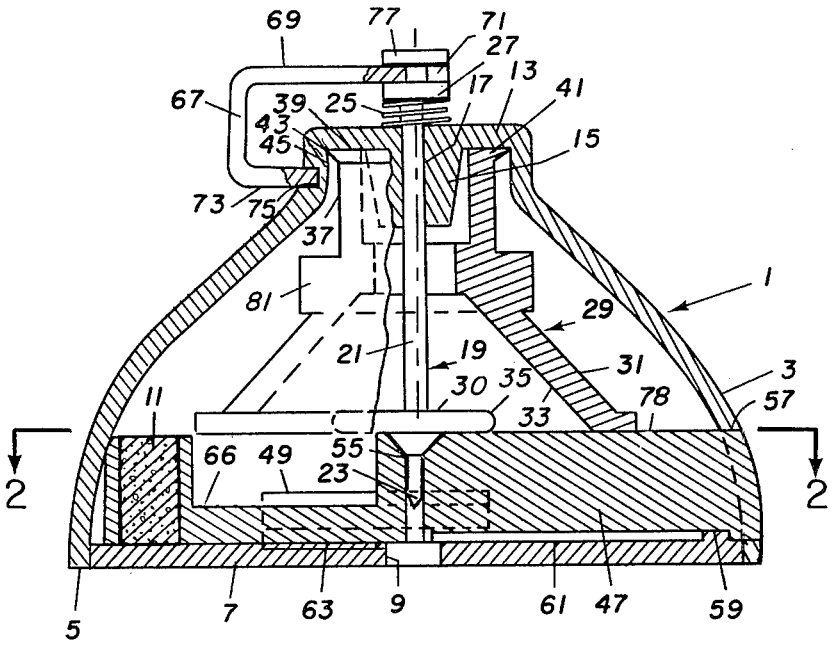
FIG. 1 is an axial section view of an impact fuze embodying the present invention, prior to impact with a target.
Figure 3:
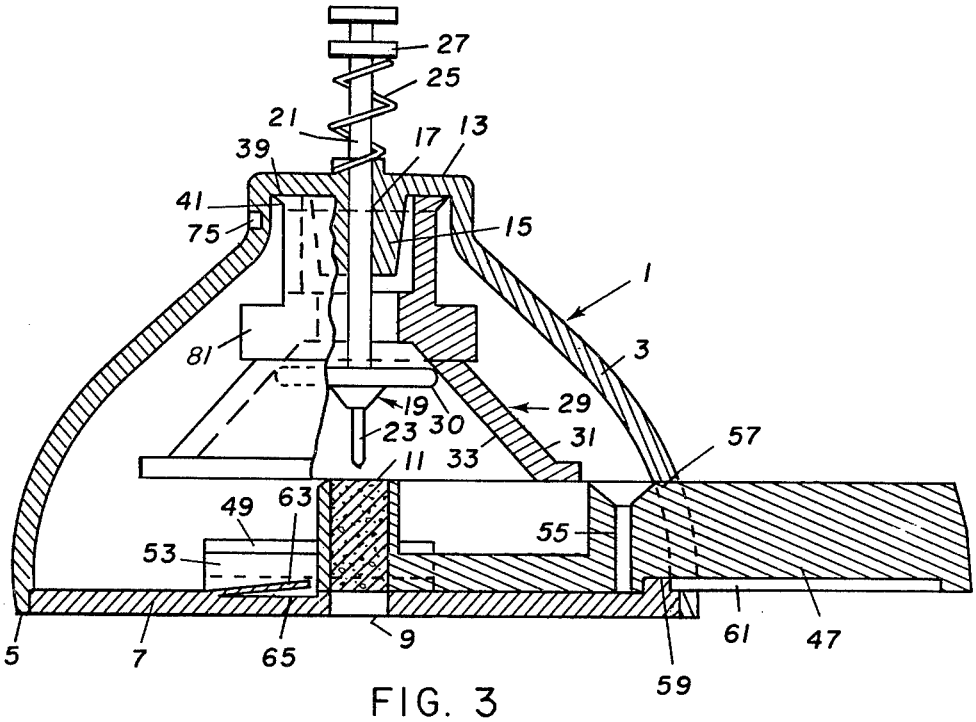
FIG. 3 is a view similar to FIG. 1 showing the parts of the fuze just after spin-arming and before impact with a target.

FIG. 1 shows a fuze 1 comprising a cup-shaped housing 3, the open rear end 5 of which is adapted to be attached by any suitable means to a projectile (not shown) containing an explosive charge to be initiated by the fuze. The open end 5 is closed by a plate 7 having a central opening 9 providing communication between the fuze 1 and the projectile charge. In the armed condition of the fuze, shown in FIG. 3, an axially-extending detonator 11 is located in alignment with opening 9. The forward end 13 of the housing 3 (the base of the cup) is formed with an internal boss or collet 15 containing an axial bore 17 aligned with the opening 9. A firing pin or member 19 comprises a shaft 21, which is slidably mounted in axial bore 17, and a firing point or pin 23 adjacent to, but normally spaced from, detonator 11. The firing pin 19 is resiliently or yieldably biased forwardly, away from the detonator 11, in the armed condition of FIG. 3, by a relatively weak coil spring 25 interposed between the end 13 and a circular flange 2 on the firing pin 19. In this position, the shaft 21 would be actuated directly by head-on impact with a target.

In accordance with the present invention, an annular inertial actuator 29 is operatively interposed between a second circular firing pin flange 30 and the closed forward end 13 of the housing 3. Actuator 29 comprises a larger diameter, annular, rear portion 31 having a rearwardly-facing, internal, conical surface 33, which engages the forward edge 35 of the periphery of the firing pin flange 30, and a smaller diameter, tubular, forward portion 37 which surrounds the boss 15 and is located adjacent to the inner surface 39 of end 13, and contacts surface 39 under the bias of spring 25 in the armed condition of FIG. 3, prior to impact. The tubular portion 37 comprises an external, annular, knife-edge rib 41 providing a narrow, annular, bearing surface 43 located adjacent to a cylindrical inner surface 45 on housing 3. The diameter of surface 43 is less than that of surface 45 so that these two surfaces can contact each other at only one point at a time. The total mass of the actuator is made large compared to that of the firing pin 19, for most efficient operation.

Figure 2:
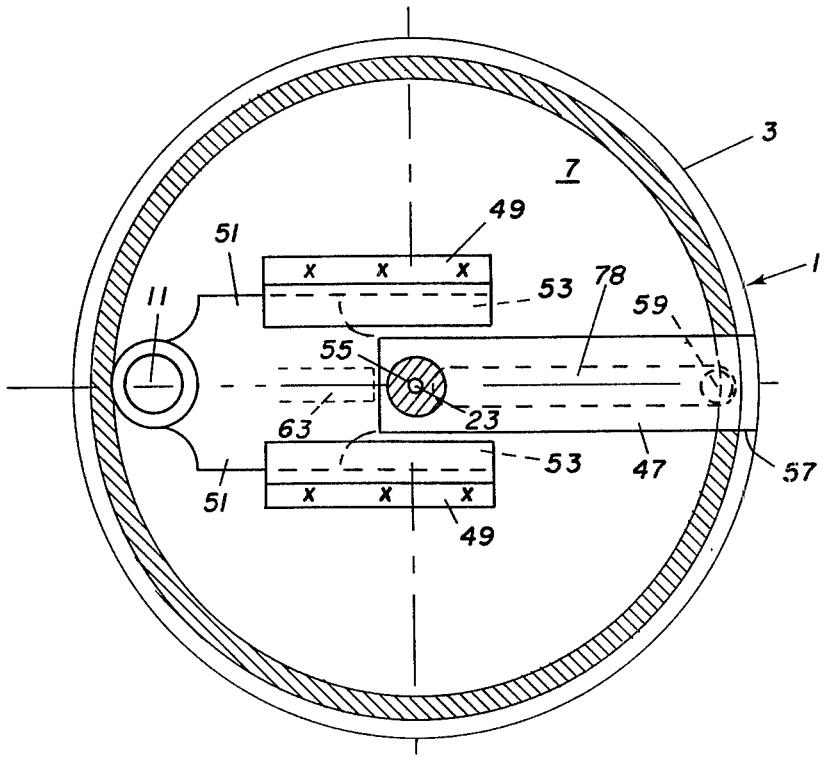
FIG. 2 is a transverse section view taken on line 2—2 of FIG. 1.

The detonator 11 is carried at one end of an arming slide 47 of rectangular cross section, which is transversely slidable on cover plate 7 between two substantially Z-shaped guide strips 49 attached or integral with the cover plate. Slide 47 includes two lateral ribs 51 which slide in two guide channels 53 formed by the two guide strips 49 and the cover plate 7, as shown best in FIG. 2. Slide 47 has a central aperture 55 which receives the point 23 of the firing pin prior to launch of the projectile, to positively lock the slide 47 in the safe position shown in FIG. 1 wherein the detonator is out of line with the firing pin 19. To permit movement of the slide 47 and detonator 11 to the armed position of FIG. 3, the housing 3 is formed with a rectangular opening 57. The cover plate 7 has an upstanding projection or pin 59 which extends into a channel 61 in slide 47 to limit the outward movement of the slide. A leaf spring 63, which may be integral with, or mounted in a recess 65 in, the cover plate 7, is provided to hold the slide 47 in armed position. The slide 47 is cut-away to form an elongated notch 66 to provide clearance for the large diameter rear portion 31 of the actuator 29 at firing. Prior to launch, the firing pin 19 is held in safe position, with the spring 25 fully compressed, by a safety clip 67, in the form of a U-shaped metal strap having a long leg 69 with a forked end 71 overlying the firing pin flange 27, and a short leg 73 extending into a notch 75 in the housing 3. A third flange 77 on the firing pin, spaced from flange 27, prevents binding of leg 73 in notch 75.

Figure 4:
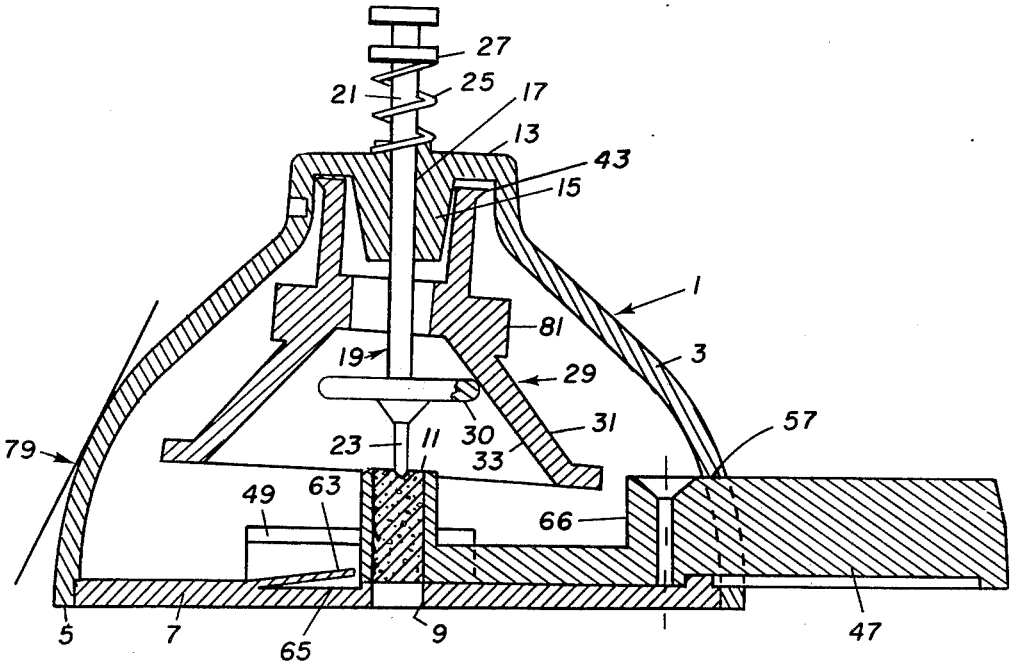
FIG. 4 is a view similar to FIG. 1 showing the parts just after graze impact with a target.

In operation, the projectile (not shown) is launched from a conventional rifled launch tube or barrel with the fuze 1 initially in the safe condition shown in FIG. 1. In this condition, firing movement of the actuator 29 is prevented by the upper surface 78 of the slide 47 and the inner surfaces 39 and 45 of the housing 3. During launch, the projectile is spun about its axis by the rifling, causing the fuze to spin. The safety clip 67 is first removed by centrifugal force, which releases the firing pin flange 27. The spring 25 now moves the firing pin to armed position, with the flange 30 engaging the conical actuator surface 33, withdrawing the point 23 from aperture 55 and releasing the slide 47. In this position, the spring 25 serves as a creep spring preventing rearward movement of the actuator 29. The slide 47 now moves by centrifugal force to the armed position of FIG. 3, aligning the detonator 11 with the firing point 23, being stopped by pin 59 and held by leaf spring 63 which springs up behind the end of the slide, and aligning the clearance notch 66 with activator 29. At graze impact, for example with a target surface making contact with one side of the fuze housing 3 at an angle near 90°, as indicated by the arrow 79, the lateral impact force causes the actuator 29 to move or shift laterally in the opposite direction in the housing 3, as shown in FIG. 4. Initially, the actuator 29 shifts bodily until surface 43 contacts surface 45, after which the actuator 29 pivots about the narrow surface 43 as a fulcrum, as permitted by clearance notch 66. As the lower portion 31 shifts and pivots (to the left in FIG. 4) the conical surface 33, by its engagement with the forward edge 35 of flange 30, positively cams or moves the firing pin 19 rearwardly, against the bias of weak spring 25, driving the point 23 into the detonator 11, which in turn detonates and initiates the projectile charge (not shown) through opening 9. The actuator may be weighted, as shown by the ring 81, to increase its mass. Preferably, the periphery of the circular flange 30 is rounded as shown, to minimize friction between the camming surfaces.

The invention is not limited to forward motion of the projectile and fuze at impact. Instead, the projectile may be tumbling at impact, and a rear edge of the projectile may impact a target and produce a lateral force component on the actuator 29 to fire the detonator 11.

Instead of using a spring (25) to retract and hold the firing pin (21) spaced from the detonator (11) in armed position, a firing pin threaded within a retainer may be unthreaded and withdrawn from the detonator by a stabilizer ribbon, as in the copending application of William G. Wolterman, Ser. No. 282,081, filed 11 Aug. 1972, now U.S. Pat. No. 3,891,162, granted 24 June 1975 assigned to the same assignee.

Any suitable materials may be used for the various parts of fuze 1. For example, the housing 3 may be of aluminum or a plastic, and the cover plate 7, firing pin 21, slide 29 and clip 67 may be of steel.

The foregoing disclosure and drawings are merely illustrative of the principles of this invention, which is limited only by the following claims.

What is claimed is:

1. An inertial, wide-angle, impact fuze, comprising:

an open cup-shaped housing including a rear end adapted to be attached to an explosive projectile and a closed front end having an axial bore;

a percussion-type detonator disposed in said housing in alignment with said bore;

a firing pin, of relatively small mass, for initiating said detonator, slidably mounted in said bore, and having a circular flange;

means for maintaining said firing pin spaced axially from said detonator in armed condition prior to impact; and an annular inertial actuator, of relatively large mass compared to said firing pin, completely within said housing, comprising a rear portion having an internal conical surface surrounding said firing pin flange and adapted to shift laterally by inertia on graze impact of said fuze with a target to engage the periphery of said flange and drive said firing pin into said detonator.

2. A fuze as in claim 1, wherein a portion of said firing pin extends forward beyond said housing and said actuator for direct actuation by direct impact with a target.

3. A fuze as in claim 2, further comprising a second flange on said extending portion of said firing pin, and a coil spring interposed between said housing and said second flange.

4. A fuze as in claim 1 wherein the periphery of said circular flange is rounded.

5. A fuze as in claim 1, wherein said housing includes a cylindrical internal annular surface adjacent to said front end, and said actuator includes a relatively-narrow external annular surface having a diameter less than and located adjacent to said internal annular surface, whereby on graze impact said external annular surface contacts said internal annular surface to form a fulcrum about which said actuator pivots as said rear portion shifts laterally in said housing.

6. A fuze as in claim 5, wherein said external annular surface is formed by a knife-edge rib.

7. A fuze as in claim 1, wherein said detonator is mounted on a spin-actuated arming slide mounted for transverse movement in said housing to move said detonator from a safe position out of line with said firing pin to an armed position in line with said firing pin.

8. A fuze as in claim 7, wherein said firing pin extends into a locking aperture in said arming slide when said detonator is in said safe position; and said fuze further includes a spin-releasable clip locking said firing pin in said locking aperture prior to launch.

9. A fuze as in claim 1, wherein said slide includes a surface engageable by said actuator to prevent firing movement thereof in said safe position but out of the path of said actuator in said armed position.

* * * * *